United States Patent [19]
Burysek et al.
[11] 4,317,545
[45] Mar. 2, 1982

[54] METHOD OF AND APPARATUS FOR EXCHANGING FULL BOBBINS FOR EMPTY ONES IN TEXTILE MACHINES, PARTICULARLY OPEN-END SPINNING MACHINES

[75] Inventors: Frantisek Burysek; Jaroslay Dykast, both of Usti nad Orlici, Czechoslovakia

[73] Assignee: Vyzkumny ustav bavlnarsky, Usti nad Orlici, Czechoslovakia

[21] Appl. No.: 121,483

[22] Filed: Feb. 14, 1980

[30] Foreign Application Priority Data

Feb. 15, 1979 [CS] Czechoslovakia ..... 1020-79

[51] Int. Cl.[3] ..... B65H 54/02; B65H 67/04

[52] U.S. Cl. ..... 242/18 A; 242/18 PW; 242/19

[58] Field of Search ..... 242/18 A, 18 PW, 18 EW, 242/35.5 A, 35.5 R, 18 DD, 19, 35.6 R

[56] References Cited

U.S. PATENT DOCUMENTS 3,761,029 9/1973 Seney ..... 242/18 A
3,948,452 4/1976 Burysek et al. ..... 242/18 A
4,108,388 8/1978 Schar ..... 242/18 PW X
4,125,990 11/1978 Stahlecker et al. ..... 242/18 PW X

*Primary Examiner*—Stanley N. Gilreath

[57] ABSTRACT

Method of and apparatus for exchanging full bobbins for empty ones in textile machines, particularly open-end spinning machines with take-up and winding rollers for taking-off and winding yarn on a bobbin. An end of yarn severed between said take-up rollers and said winding rollers is introduced into the tube of an empty bobbin in three phases. In the first phase, a preparation step for gripping the yarn between the take-up rollers and the winding rollers takes place; in the second phase the delivery yarn is gripped and severed; and in the third phase the gripped yarn end is introduced into the interior of the bobbin tube at least over its entire length, and is simultaneously prevented from being untwisted at the tube edge.

In one embodiment of the apparatus for carrying out the method of exchanging full bobbins for empty ones, the introduction of yarn into the tube interior is effected by a gripper with a revolving arm, one part of which, designed for passing, in the first phase, through the tube of an empty bobbin, is longer than the length of the tube. In another embodiment of the apparatus, the introduction of yarn into the tube interior is effected by a gripper with two reciprocatory arms, one of which is a yarn deflecting arm and the other of which is a yarn introducing arm.

15 Claims, 5 Drawing Figures

METHOD OF AND APPARATUS FOR EXCHANGING FULL BOBBINS FOR EMPTY ONES IN TEXTILE MACHINES, PARTICULARLY OPEN-END SPINNING MACHINES

The present invention relates to a method of and apparatus for exchanging full bobbins for empty ones in textile machines, particularly open-end spinning machines in which produced yarn is withdrawn by take-up rollers and is wound on a bobbin by winding rollers.

A system for exchanging full bobbins for empty ones is dislosed in U.S. Pat. No. 3,948,452. In the method there disclosed a severed yarn end delivered by the take-up rollers is introduced, substantially at the take-up speed, into the interior of an empty bobbin predriven to a winding speed before being mounted in the machine in a winding position.

The apparatus for carrying out the above-mentioned method comprise means for predriving the empty bobbin, and means for introducing the yarn end into the bobbin tube by a gripper or by an axially slotted air duct by which the yarn end is blown into the empty bobbin.

Such apparatus is disadvantageous in that a suitable yarn length to be introduced into the bobbin tube cannot be reliably controlled; this results in the yarn end falling out of the tube, or in the loss of the yarn position in which the yarn end is gripped between the tube edge and an arm of the bobbin holder.

Another known apparatus disclosed in the DE-AS No. 23 64 089 (Toyoda) is adapted to travel along the winding units and is provided with a cutting device for severing the withdrawn yarn and for sucking if off in the proximity of said device. However, the invention fails to solve the problem of how to wind the sucked-off yarn after the exchange of a full bobbin for an empty one. Even in the continuation application DE-AS No. 23 64 158 (Toyoda) the problem has not been solved.

There are also known doffing devices on automatic winding machines, wherein after bobbin exchange, a yarn reserve is either not produced at all, or a reserve is produced in the form of several initial turns on the end portion of the empty bobbin. However, the thus produced reserve turns or winds tend to slip off the bobbin and their ends are untwisted; this results in a loss of yarn strength so that the yarn end cannot be satisfactorily tied up, or in yarn breaks at the piece-up point.

It is an object of the present invention to eliminate the disadvantages as hereinabove set forth and to provide, in the bobbin exchange process, the production of a sufficiently long and strong yarn reserve without any risk of yarn end untwisting.

In accordance with the invention, the yarn end is introduced into the interior of the bobbin tube in three phases: in the first phase a preparatory step for gripping the yarn end takes place, in the second phase, the delivered yarn is gripped and severed, and in the third phase the gripped yarn end is introduced at least along the entire length of the tube interior.

According to another feature of the invention, the yarn end is gripped and introduced into the interior of the empty tube without being untwisted.

An apparatus in accordance with the invention for carrying out the above method of exchanging full bobbins for empty ones includes a revolving gripper, designed for gripping and introducing the yarn end into the interior of the bobbin tube has an arcuate, or crank shape.

It further is advantageous to embody the holding means for gripping and introducing the yarn end into the tube as a suction nozzle arranged on the gripper.

In accordance with another preferred embodiment of the invention, the holding means for the gripper can be formed as a yarn catching hook, or of a combination of such hook with the afore-said suction nozzle. It is also to be understood that a reciprocatory arm of the gripper for introducing the yarn end into the tube can be equipped in this manner.

Preferably, the interior of the tube, possibly its edge, can be provided with projections, points, notches or any other structural surface elements designed for gripping the yarn end after such end has been introduced into the tube interior.

Another feature of the invention is the removal of an excess end portion of the yarn once introduced into the bobbin tube.

Some preferred embodiments will be hereinafter described with reference to the accompanying schematic drawings, in which.

Figure 4:
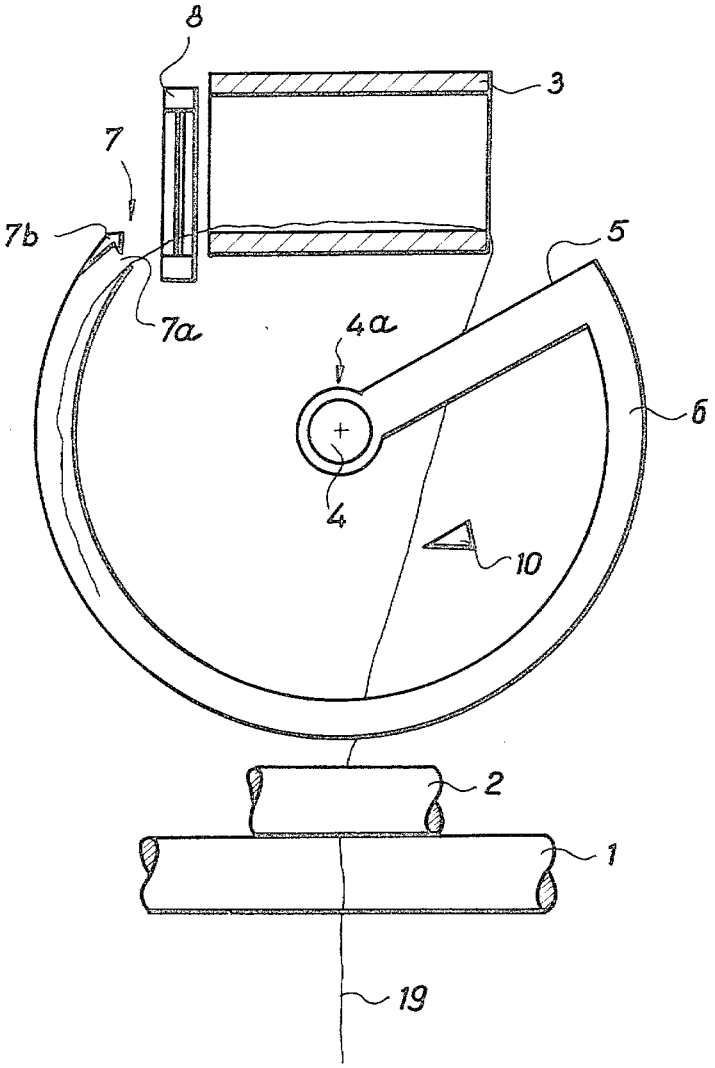
Figure 5:
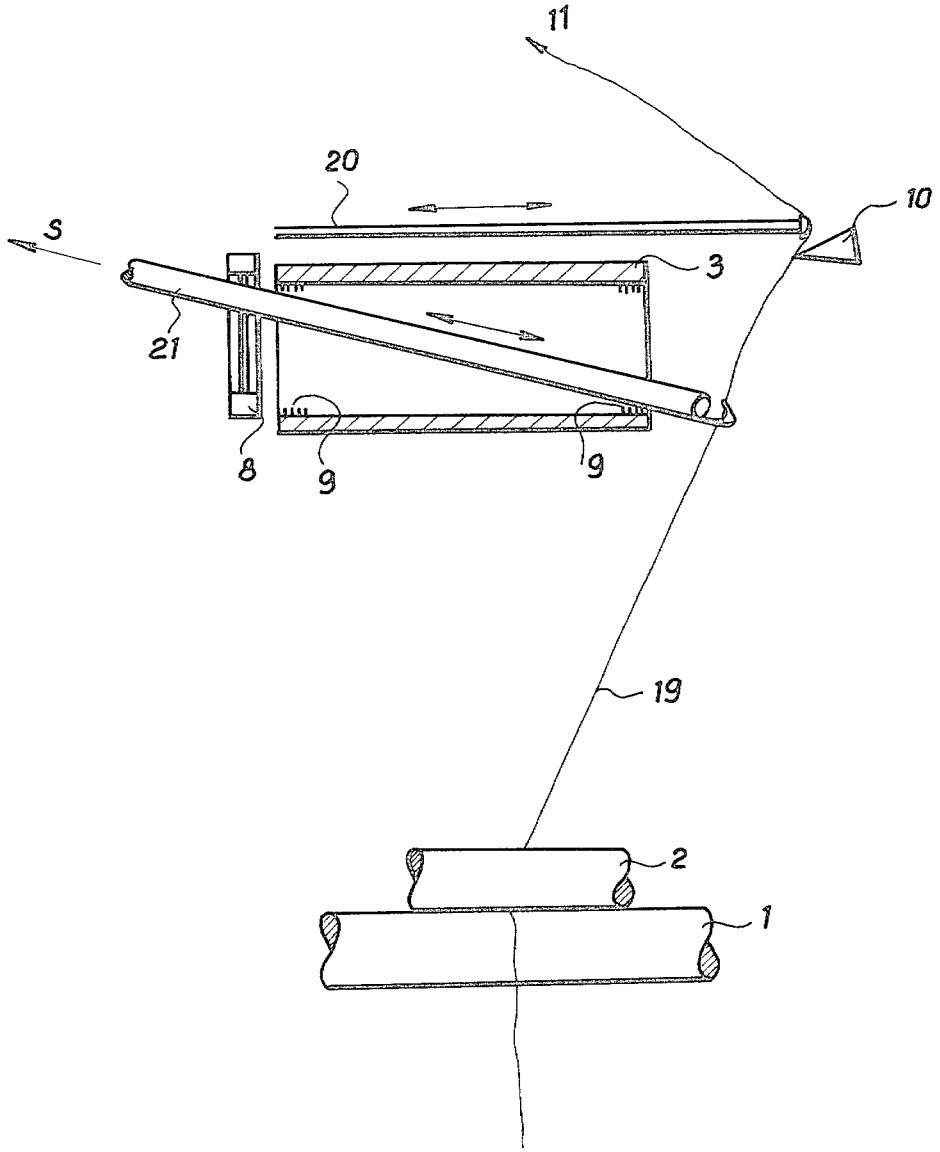

FIG. 4 shows the rocking gripper of the preceeding figures in its third phase in which it returns to its initial position while the yarn is introduced to the tube along its entire interior, the excess yarn portion being possibly cut off; and FIG. 5 shows a second embodiment of the apparatus of the invention with a reciprocatory gripper in the second phase of its motion; in such embodiment one of the gripper arms swings out and severs the delivered yarn while the other arm thereof, having passed through the tube interior, grips the severed yarn portion and introduces it during its return motion into the tube interior along its entire length.

In FIGS. 1–4, incl., the gripper is embodied as a revolving lever a part of which is substantially a circular arch with the revolution center in this arch. The thus formed arcuate lever is rockable between two extreme positions, the first upper one being the lever starting position and the other lower one being the position in which the yarn is gripped downstream of the take-up rollers. During the return motion of the lever back to the upper position, a severed yarn end is delivered at a speed which may substantially correspond to the peripheral velocity of the take-up rollers.

The yarn is gripped either by a catching hook, or by a suction nozzle provided both at the extremity of the arcuate lever. In the last-mentioned case the arcuate arm is hollow and is connected to a subatmospheric pressure source.

The above two alternatives can be preferably combined with each other so that in the second phase, the delivered yarn is gripped by the hook and, after having been severed, sucked into the hollow arcuate arm.

After having been introduced into the tube, the yarn bears on its inner wall provided with a structural surface such as in the form of points, notches, roughening, or the like, whereby the introduced yarn end portion is caused to adhere to said wall and is thus prevented from being untwisted. For this purpose it has also been found advantageous to introduce into the tube a yarn length exceeding the tube length. The excess yarn end portion is then cut off close to the tube edge and is sucked off by said suction nozzle while the yarn end remains gripped in the tube interior.

With the subsequent yarn processing (as e.g. weaving in a loom) in view, it is made possible to piece up yarn end to another package in such manner that no strength loss occurs which may otherwise have been encountered due to end untwisting.

However, the reliability of introducing yarn into the tube of an empty bobbin remains unaffected even if the cutting device is omitted, since the outstanding yarn end can be gripped between the bobbin holder arms and the tube edge when the tube is placed in the spooling position after the exchange of a full bobbin for an empty one has been completed.

Turning first to FIGS. 1–4, incl., yarn 19 is supplied by a pair of take-up rollers 1 and 2 from a spinning or other device (not shown) to a yarn winding mechanism 11 comprising a bobbin tube 3. A yarn inserter is embodied, according to FIGS. 1 through 4, as a revolving gripper consisting of a straight arm 5. and an arcuate arm 6 which latter is longer than the tube 3. The gripper 5,6 is journalled in a bearing 4*a* to turn about an axis 4. Adjacent the bobbin tube 3 which can be in a position in which it is given, by not shown means, a drive necessary to rotate at a peripheral speed substantially corresponding to the yarn take-up speed, a cutting device 8 of known construction is arranged. The end portion of the gripper arm 6 is formed as a combination of a suction nozzle 7*a* and a yarn catching hook 7*b*. Close to the path of the withdrawn yarn there is disposed a cutting blade 10.

Figure 1:
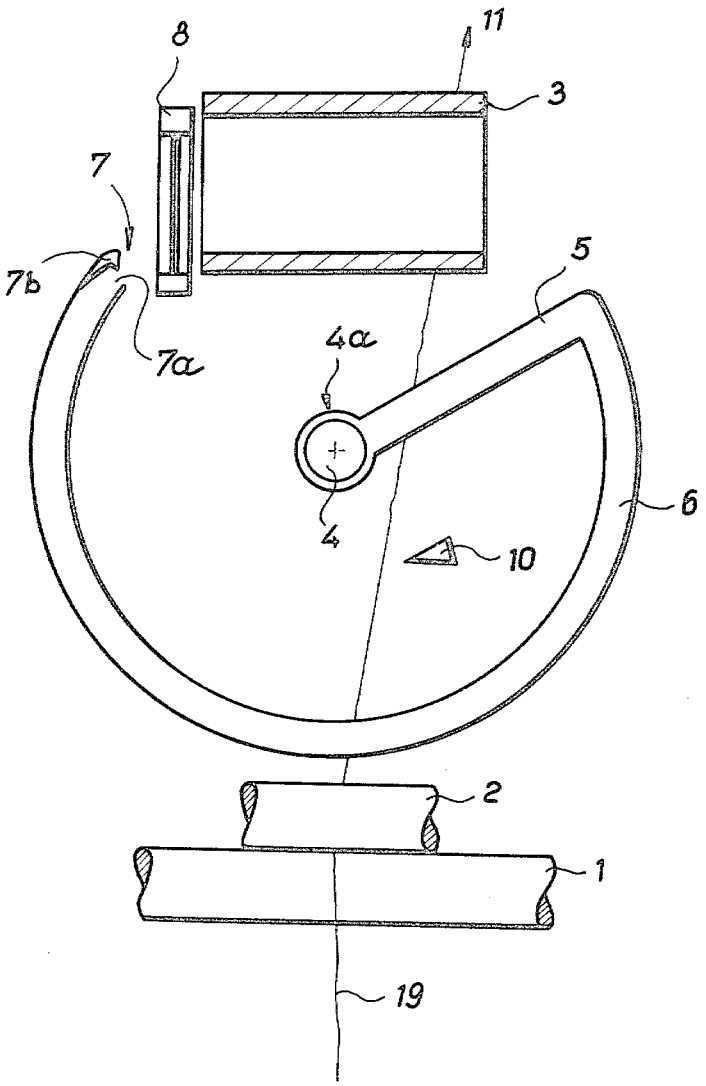
FIG. 1 shows a revolving gripper in its initial position.
Figure 2:
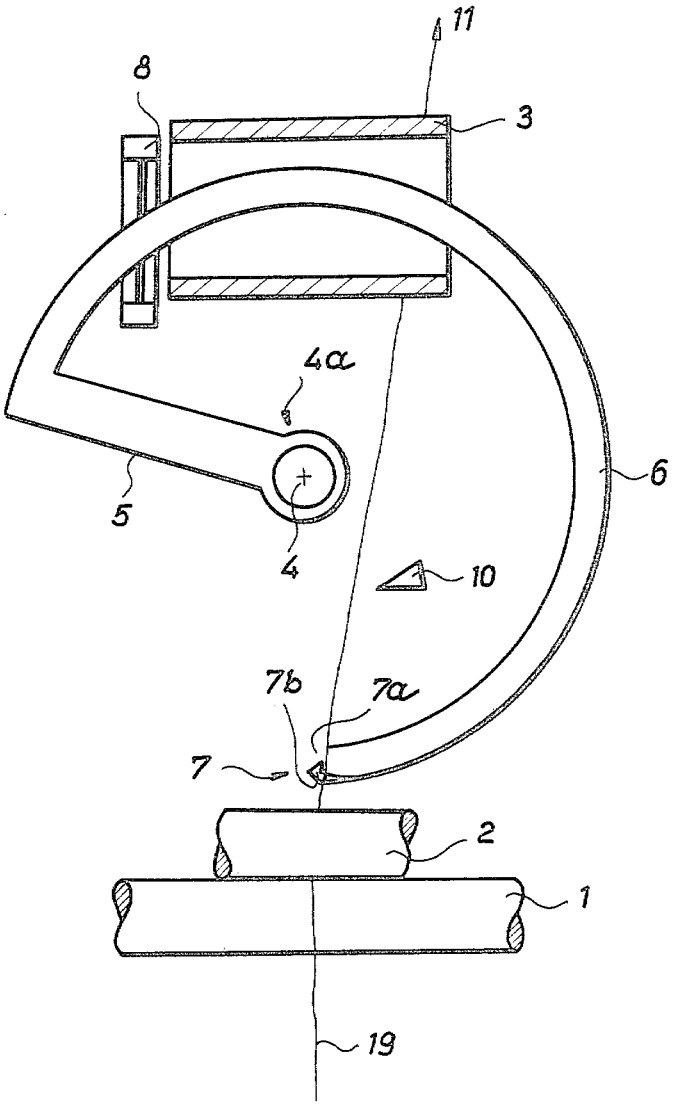
FIG. 2 shows the gripper of FIG. 1 at the end of the first phase of its motion after the passage thereof through the tube interior, and also shows a part of the second phase in which the yarn delivered by the take-up rollers to the bobbin just before its completion is gripped by the gripper.
Figure 3:
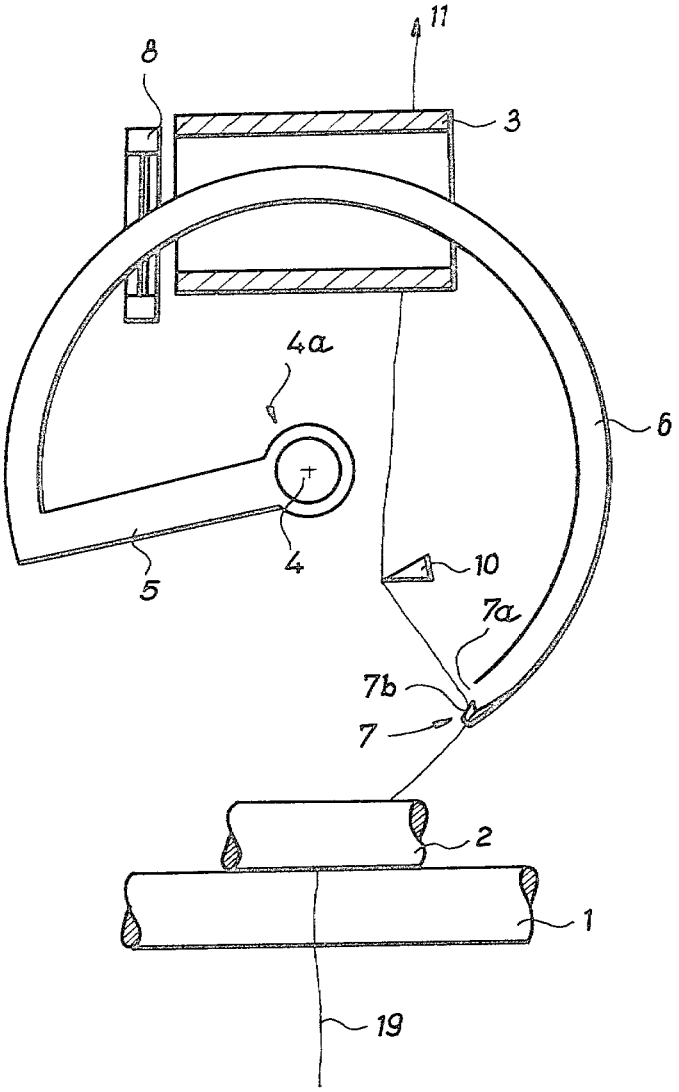
FIG. 3 shows the revolving gripper of FIGS. 1 and 2 after completion of the second phase when the delivered yarn is severed by said gripper during the return motion of the latter.

The apparatus of FIGS. 1–4 incl., operates as follows:

As it is apparent from FIG. 1, the gripper 5, 6 is in its initial position in which the end portion of its arm 6 in its top dead center position faces the tube 3 of an empty bobbin as well as the cutting device 8 so that said end portion points to the tube interior. In the first phase of the gripper motion (FIG. 2) the arm 6 has passed through the tube 3 into its lower dead center close to the path of yarn 19 withdrawn by the takeup rollers 1 and 2 so that the gripping means 7 can grip the yarn 19 in the second (see FIG. 3) and deflect it aside toward the cutting blade 10 to be severed.

The yarn 19 keeps being gripped by the gripping means 7, and in the third phase (FIG. 4), it is introduced into the tube 3 along its entire length. By being bent over the tube edge, the yarn 19 is gripped while its end is exactly trimmed by the optional cutting device 8 so that the yarn length introduced into the tube 3 may substantially correspond to the tube length. The cut-off yarn length can be then sucked off by the suction nozzle 7*a* of the hollow gripper arm 6 connected to a subatmospheric pressure source (not shown) by a swivel pipe joint at 4*a*. The speed of the yarn introducing means motion can be chosen in dependence upon the yarn take-up speed. In a similar way, it is possible to predetermine the yarn length to be introduced into the interior of the bobbin tube 3.

In an alternative embodiment, shown in FIG. 5, the yarn 19 is withdrawn by take-up rollers, 1, 2, to the tube 3. Before being cut off by the cutting blade 10, the yarn is deflected by a deflecting arm 20 of the gripper and then, once cut off, it is introduced into the tube 3 by another arm 21 by means of the catching hook 7*b* combined, possibly, with suction S; in this case the yarn is sucked into said arm 21 which is then embodied as a pipe. It will be seen that the apparatus of FIG. 5 operates in a manner which is analogous to that of the apparatus of FIGS. 1–4, incl.

The present invention makes the manual bobbin doffing unnecessary and contributes, to a considerable extent, to the perfect operation of automatic doffing systems. The yarn ends entrapped in the tube, or at its edge, as by the previously referred to points, notches, roughening or the like of the inner wall of the tube, shown by way of example at 9 in FIG. 5, remains untwisted whereby it is possible to piece up the end to another full bobbin for the following yarn processing steps.

Although the invention as illustrated and described with reference to one preferred embodiment thereof, it is to be expressly understood that it is in no way limited to the disclosure of such preferred embodiment but is capable of numerous modifications within the scope of the appended claims.

We claim:

1. A method of replacing a first, full bobbin having a core in the form of a tube by a second, similar empty one in a textile machine having take-up rollers for first forwarding yarn to yarn winding mechanism for said first bobbin and later forwarding yarn to said second bobbin, comprising gripping the yarn at a location in the span thereof between the take-up rollers and the yarn winding mechanism, severing the yarn at a place downstream of the location at which it is gripped, pulling the gripped end portion of the yarn into a first end of the interior of the second, empty tube, through such tube, and out the second end thereof, and securing the yarn against escape from the interior of the second tube.

2. A method as claimed in claim 1, including cutting off, outwardly of the second end of said second tube, any excess end portion of the severed yarn extending beyond the second end of the second tube, after the yarn in the second tube has been prevented from escape from such tube.

3. A method, according to claim 2, wherein after said excess end portion of the yarn has been severed, sucking said severed excess end portion into a collecting space.

4. Apparatus for replacing a first, full bobbin having a core in the form of a tube by a second, similar empty one in a textile machine having take-up rollers for first forwarding yarn to yarn winding mechanism for said first bobbin and later forwarding yarn to said second bobbin, comprising means for gripping the yarn at a location in the span thereof between the take-up rollers and the yarn winding mechanism, means for severing the yarn at a place downstream of the location at which it is gripped, means for pulling the gripped end portion of the yarn into a first end of the interior of the second, empty tube, through such tube, and out the second end thereof, and means for securing the yarn against escape from the interior of the second tube.

5. An apparatus as claimed in claim 4, wherein the means for introducing yarn into the tube interior comprises a gripper with two reciprocatory arms of which one is a yarn deflecting arm and the other is a yarn introducing arm.

6. An apparatus as claimed in claim 5, wherein the yarn introducing arm of the gripper is provided with a catching hook.

7. An apparatus as claimed in claim 5, wherein the yarn introducing arm of the gripper is hollow, and the catching hook is arranged adjacent the opening of said arm.

8. An apparatus as claimed in claim 4 comprising a yarn cutting device disposed outwardly of the second end of the second bobbin tube for severing the excess end portion of the yarn extending beyond the second end of the second tube.

9. An apparatus as claimed in claim 4, wherein the gripper is rotatable and at least a portion of the yarn introducing arm of the gripper has an arcuate shape.

10. An apparatus as claimed in claim 9, wherein the end portion of the rotatable arm of the gripper is provided with holding means for gripping the yarn.

11. An apparatus as claimed in claim 10, wherein the gripping means of the gripper is the catching hook for entrapping the yarn.

12. An apparatus as claimed in claim 10, wherein the arm of the gripper is hollow, and the holding means is a suction nozzle provided on the hollow arm of the gripper.

13. An apparatus as claimed in claim 10, wherein the gripping means is a combination comprising a catching hook and a suction nozzle arranged at the end of the yarn introducing arm.

14. An apparatus as claimed in claim 4, wherein the bobbin tube is provided on its yarn-engaging surface with projections for holding the end of yarn introduced into said second bobbin tube.

15. An apparatus as claimed in claim 12, wherein the hollow arm is connected to a collecting space subjected to subatmospheric pressure.

* * * * *